US005761760A

United States Patent [19]

Dumler et al.

[11] Patent Number: 5,761,760

[45] Date of Patent: Jun. 9, 1998

[54] MASCARA BRUSH

[75] Inventors: Norbert Dumler, Anspach; Friederich Lang, Bechhofen a. d. Heide, both of Germany

[73] Assignee: Estee Lauder Inc., New York, N.Y.

[21] Appl. No.: 576,425

[22] Filed: Dec. 21, 1995

[30] Foreign Application Priority Data

Dec. 24, 1994 [DE] Germany ..... 44 46 521.1

[51] Int. Cl.[6] ..... A46B 3/16

[52] U.S. Cl. ..... 15/206; 15/160

[58] Field of Search ..... 15/159.1, 160, 15/206, 207.2; 132/218; 401/119, 129

[56] References Cited

U.S. PATENT DOCUMENTS

| | | |
|---|---|---|
| D. 98,940 | 3/1936 | Hertzberg . |
| D. 109,634 | 5/1938 | Beveridge . |
| D. 173,852 | 1/1955 | Pope . |
| D. 201,007 | 5/1965 | Hanser . |
| D. 250,858 | 1/1979 | Yamaguchi . |
| D. 250,859 | 1/1979 | Artiano . |
| 302,201 | 7/1884 | Gladding . |
| D. 308,443 | 6/1990 | Vetter . |
| 461,604 | 10/1891 | Dietz . |
| 832,498 | 10/1906 | McHenry . |
| 919,844 | 4/1909 | Ford . |
| 1,047,021 | 12/1912 | Farnum . |
| 1,118,774 | 11/1914 | Hunter . |
| 1,151,813 | 8/1915 | Neufeld . |
| 1,173,721 | 2/1916 | Hurvitz . |
| 1,513,339 | 10/1924 | Merrihew . |
| 1,547,611 | 7/1925 | Rudolph et al. . |
| 1,576,182 | 3/1926 | Fletcher . |
| 1,588,940 | 6/1926 | Cave . |
| 1,620,008 | 3/1927 | Curtis . |
| 1,683,947 | 9/1928 | Barchfeld . |
| 1,711,741 | 5/1929 | Nelson . |
| 1,910,153 | 5/1933 | Eisenhut et al. . |
| 2,039,052 | 4/1936 | Beck et al. . |
| 2,223,783 | 12/1940 | Fletcher . |
| 2,279,209 | 4/1942 | Snyder . |
| 2,627,621 | 2/1953 | Bardugan . |
| 2,757,399 | 8/1956 | Garzelloni . |
| 2,790,987 | 5/1957 | Kirkpatrick . |
| 3,582,140 | 6/1971 | Kaufman . |
| 3,837,751 | 9/1974 | Ross . |
| 3,896,823 | 7/1975 | Spatz . |
| 4,433,928 | 2/1984 | Kingsford . |
| 4,446,880 | 5/1984 | Gueret . |
| 4,586,520 | 5/1986 | Brittain . |
| 4,632,136 | 12/1986 | Kingsford . |
| 4,671,689 | 6/1987 | Gueret . |
| 4,733,425 | 3/1988 | Hartel et al. . |
| 4,861,179 | 8/1989 | Schrepf et al. . |
| 4,887,622 | 12/1989 | Gueret . |
| 4,941,227 | 7/1990 | Sussman . |
| 4,958,402 | 9/1990 | Weihrauch ..... 15/207.2 |
| 4,964,429 | 10/1990 | Cole . |
| 4,974,612 | 12/1990 | Gueret . |
| 4,993,440 | 2/1991 | Gueret . |
| 5,020,551 | 6/1991 | Gueret ..... 15/207.2 |
| 5,067,195 | 11/1991 | Sussman . |
| 5,133,590 | 7/1992 | Fitjer . |
| 5,161,554 | 11/1992 | Fitjer . |
| 5,161,555 | 11/1992 | Cansler et al. . |
| 5,238,011 | 8/1993 | Gueret . |
| 5,345,644 | 9/1994 | Gueret ..... 15/206 |
| 5,357,987 | 10/1994 | Schrepf . |
| 5,370,141 | 12/1994 | Gueret . |
| 5,406,669 | 4/1995 | Lesiw . |
| 5,482,059 | 1/1996 | Miraglia . |
| 5,511,274 | 4/1996 | Lewis . |

FOREIGN PATENT DOCUMENTS

| | | |
|---|---|---|
| 29146 | 9/1930 | Australia . |
| 234088 | 6/1961 | Australia . |
| 555455 | 4/1958 | Canada . |
| 42 05 935 A1 | 2/1993 | Germany . |
| 2 174 895 | 11/1986 | United Kingdom . |
| WO 95/178837 | 7/1995 | WIPO . |

*Primary Examiner*—Terrence Till
*Attorney, Agent, or Firm*—Pennie & Edmonds LLP

[57] ABSTRACT

A mascara brush having a core bent into a looped or eyetype configuration is disclosed. The twisted wire core is bent by approximately 180° to form a oblong, oval rectangular or figure eight configuration having an internal reservoir adapted to receive mascara for transferring to the eyelashes.

31 Claims, 5 Drawing Sheets

FIG. 15a
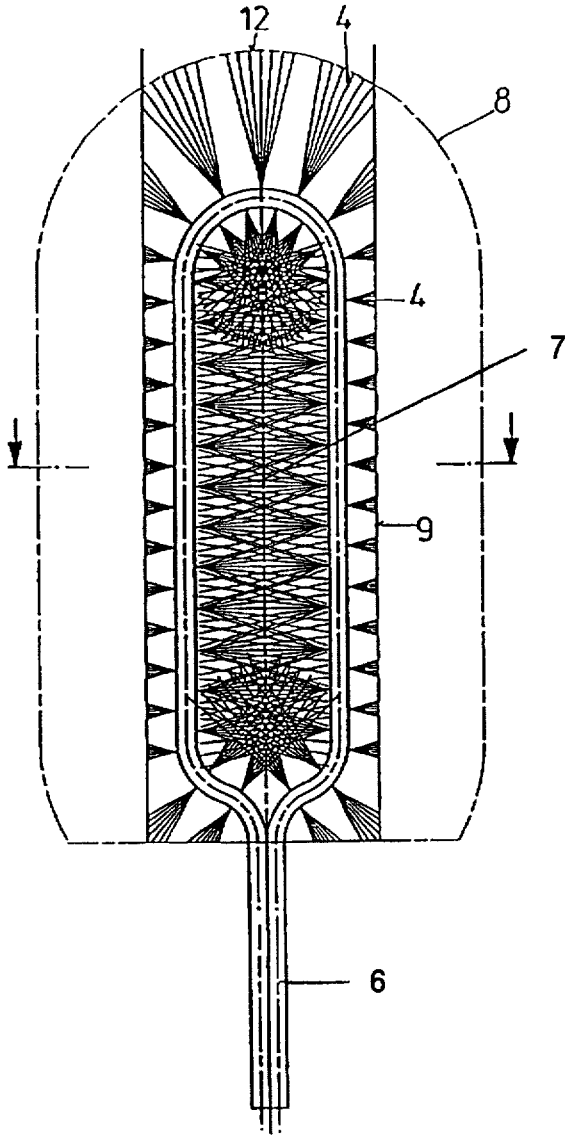
FIG. 16a
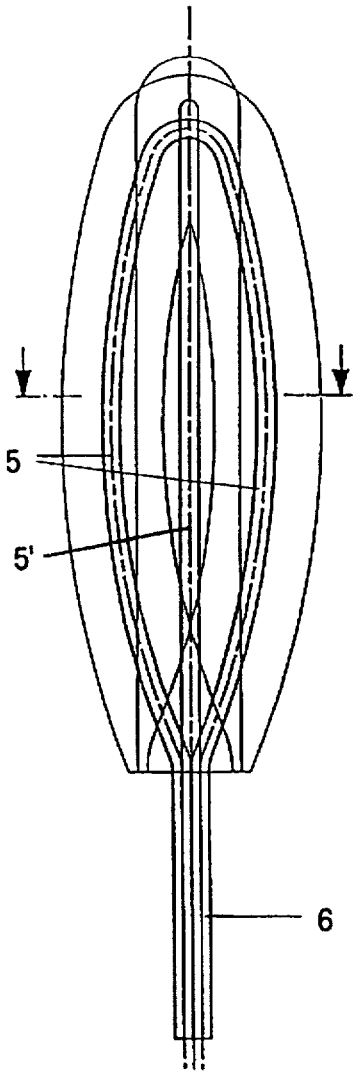
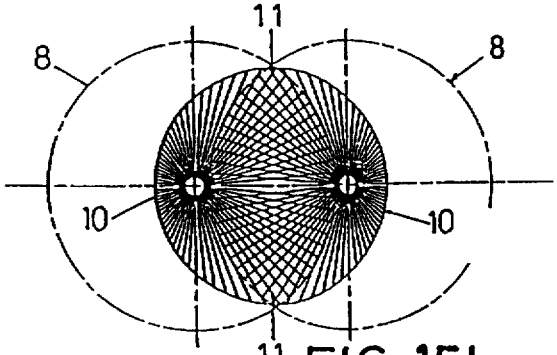
FIG. 15b
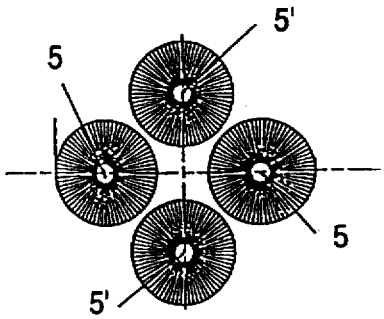
FIG. 16b

MASCARA BRUSH

BACKGROUND OF THE INVENTION

The invention relates generally to the field of mascara brushes and specifically to brushes having a core bent to form a reservoir for retaining and transferring mascara or other pasty product to the eye lashes. A mascara brush of the generic type is known for instance from GB-A-2 174 895 and DE-A-42 05 935. In these prior art mascara brushes, the bending of the core was such that the bent core sections rest directly and closely on each other, externally substantially giving the appearance of a conventional mascara brush. According to these prior art solutions, the purpose of the bending resides in that bristles project in the bent portion in prolongation of the axial direction of the core sections resting on each other, a paintbrush-like section thus being formed that ensures the application of mascara to peripheral parts of the eyelashes.

Fundamentally, mascara brushes pose the problem that the arrangement of the bristles must be such as to ensure the uniform application of mascara and the separation of the individual lashes when combing the latter. To this end, it has been known per se to equip mascara brushes with bristles of differing length or differing rigidity or to provide different sections of the brush for the application on the one hand and for the combing on the other.

A further general problem with the mascara brushes of the species resides in the liquid transfer from the reservoir of a mascara unit to the eyelashes. To this end, the mascara brush must have a receptivity and storage capacity for the liquid. On the one hand, this is accomplished on every individual fiber or bristle. To this effect it is known to design the fibers for instance as hollow fibers, as fibers with a capillary outer groove or to otherwise provide for some structuring and enlarging of the surface of the individual fibers. Moreover, storage capacity is available in the interspace between the individual fibers where mascara liquid is retained because of the surface tension.

Ultimately, the distribution of the tips along the envelope curve of the brush is of some importance, too. Whereas a helical tip distribution was preferred formerly, the aim has recently been to achieve at least partially as uniform as possible a tip distribution, there being the proposal to achieve this aim by means of hollow fibers or of fibers consisting of glued fiber segments which are treated with a solvent after the production of the brush so that the fiber segments dissolve and very fine, separated fiber segments result that are uniformly distributed over the surface.

Finally, for the construction of mascara brushes, it has to be taken into account that the users exhibit a high degree of individual demands and wishes resulting from differing usage and types of lashes. For individual adaptation it is even known to make applicators for applying mascara individually adaptable through adjustable axial tensions by means of a corresponding mechanism.

SUMMARY OF THE INVENTION

It is accordingly the object of the invention to embody a mascara brush such that optimal properties for the transfer of the mascara are achievable, that a unique appearance is created and that ultimately, there is the possibility to adapt the brush to the individual wishes of the user.

In accordance with the invention this object is attained in that the core of the mascara brush formed by the intertwisted wire segments is bent, forming at least one loop or eye-type configuration. Preferably, the ends of the bent core are united, forming a handle.

The at least one loop or eye-type configuration improves the transfer properties because, as a result of the surface tension of the mascara liquid, the loop or eye forms a reservoir, whereby greater quantities of mascara can be transferred. As a further result of the eye, the brush has a certain deformability so that the user can adjust or correct the specific form by pressing from the outside to make it comply with her wishes. Further, as a result of such an eye-type configuration, there is inherently a deviation from the cylindrical envelope curve, so that in combination with a corresponding wiper or scraper, zones can be realized on the brush that are moistened more or less densely with mascara. If, for example, the scraper has a circular cross-section and the envelope curve of the mascara brush has an oval cross-section, then the scraping effect will be more pronounced at the stronger ends of the oval than at the less curved oval areas.

The foregoing shows that the brush according to the invention ensures not only a distinct improvement over the transferring properties of conventional mascara brushes, but simultaneously helps create an unmistakable appearance accompanied by a plurality of possible variations to suit an individual user's desires. The production of such a mascara brush according to the invention can be effected conventionally, the production of a brush part having a straight core simply being followed by operations of bending and connecting the free core ends with each other to form a handle. In order to form the eye-type configuration, the core may be bent by approximately 180°. The wire preferably exhibits a diameter of from about 0.25 mm to about 1.25 mm.

The number of bristles per wire twist can range from about 5 to about 60 bristles, preferably more than 50 bristles are used. The bristles may consist of natural fibers or plastic fibers having circular, non-circular and hollow cross-sections. In the case of plastic fibers, they may be polyamide, polyester or polyacrylic fibers having a diameter of from about 0.05 mm to about 0.35 mm. In an alternative embodiment, at least one end of the bristles are mechanically split by a mechanical or chemical treatment such as is described in U.S. Pat. No. 5,133,590, which is incorporated herein by reference.

In case bristles are used having a changing diameter or a changing diameter configuration or a noncircular diameter configuration instead of a cylindrical configuration, it is conceivable to provide a theoretical cylindrical envelope around the bristles, the diameter thus defined then ranging from about .05 mm to about .10 mm.

Within the scope of the invention, the at least one loop or eye-type configuration may be approximately rectangular as well as oval, drop-shaped or circular. Alternatively, a brush having an elongated eye-type configuration may be further twisted to form a figure eight configuration thereby creating two or more loops or eyes.

In an alternative embodiment, a plurality of cores of eye-type configuration are united to form a brush. This embodiment is especially suitable when wire of a particularly small cross-section, for example, about 0.25 mm, is used to form the cores. The free ends of the cores are then connected to form a handle.

A preferred embodiment of the present invention provides for the bristles extending towards the inside or interior of the at least one loop or eye-type configuration to be spaced at least sectionally such that an inside cavity or open reservoir is formed, encased by the ends of the bristles. Alternatively, the bristles extending inward will at least touch and may overlap so that the reservoir is entirely filled with bristles.

In an alternative embodiment of the invention, the bristles are clipped prior to the core being bent, in particular to form longitudinal or transverse grooves in the bristle surface or to form a helical envelope curve. The bristles may be milled in the bending portions of the loop to reduce the density of the bristles at the bends. In this regard, account has to be made for the strong densification of the bristles taking place in the bight of more strongly bent sections. Where desired, the provided milling can counteract such a densification of bristles and provide uniform bristle density.

Alternatively, the bristles may be milled after the bending of the core. For example, if the eye-type configuration has an approximately rectangular cross-section, the bristle trimming may be milled such that the resulting outline is substantially cylindrical. It can further be provided that the eye-type configuration has an approximately rectangular cross-section and the bristles are milled such that the resulting bristle outline is substantially rotationally symmetrical, the cores are off-center, and a portion of short fibers of greater rigidity and portions of longer and softer fibers are created.

Further details of the invention will become apparent from the ensuing description of preferred embodiments, taken in conjunction with the drawings.

BRIEF DESCRIPTION OF THE DRAWINGS

FIGS. 13*a* and 13*b* illustrate a further embodiment of the invention wherein FIG. 13*a* is a plan view of the brush and FIG. 13*b* shows a cross-section of the core and bristles on an enlarged scale;

FIGS. 14*a* and 14*b* illustrate a further embodiment of the invention wherein FIG. 14*a* is a plan view of the brush and FIG. 14*b* shows a cross-section of the bristles on an enlarged scale;

FIGS. 15*a* and 15*b* illustrate a further embodiment of the invention wherein FIG. 15*a* is a plan view of the brush and FIG. 15*b* shows a cross-section of the core and bristles on an enlarged scale;

FIGS. 16*a* and 16*b* illustrate a further embodiment of the invention wherein FIG. 16*a* is a plan view of the brush and FIG. 16*b* shows a cross-section of the core and bristles on an enlarged scale.

DESCRIPTION OF THE PREFERRED EMBODIMENTS

Figure 1:
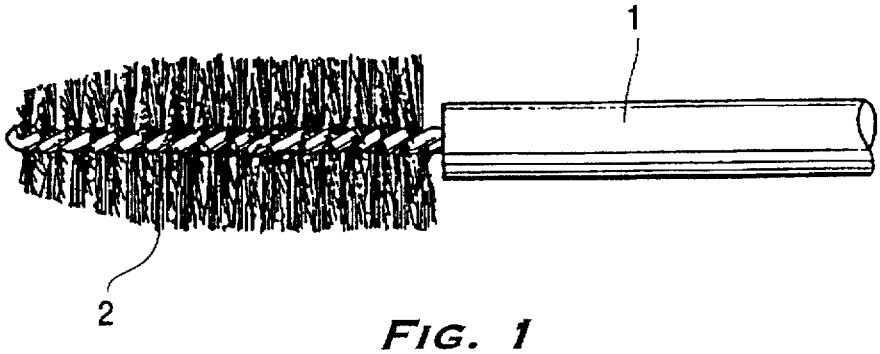
FIG. 1 PRIOR ART
FIG. 1 is a perspective view of a conventional mascara brush.
Figure 2:
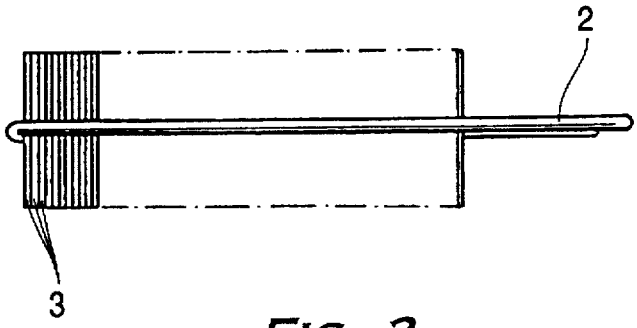
FIG. 2 PRIOR ART
FIG. 2 is a view illustrating the production of a mascara brush of the species.
Figure 3:
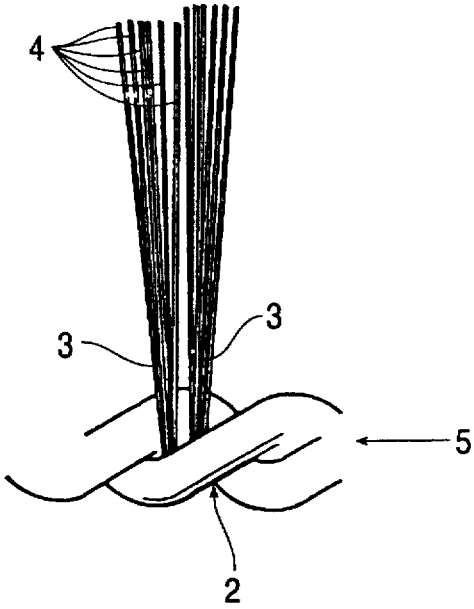
FIG. 3 PRIOR ART
FIG. 3 is a perspective view on an enlarged scale of the twists constituting the core of the mascara brush.
Figure 4:
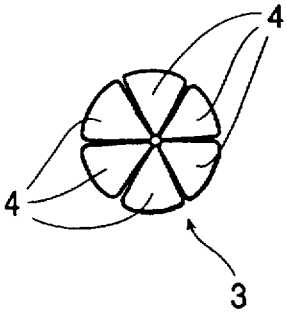
FIG. 4 PRIOR ART
FIG. 4 is a plan view on an enlarged scale of a bristle or a fiber.

A conventional mascara brush shown in FIG. 1 comprises a handle 1, in which two intertwisted wire segments 2 are fixed in place. As seen in FIG. 2, bristle fibers 3 are placed between two wire segments 2 and are then fixed in place by the wire segments 2 being twisted, as seen in FIG. 3. The most various fibers may be used for the bristles 4, depending on the desired properties of the finished brush. In the embodiment according to FIGS. 3 and 4, so-called BICO bristle fibers are used. These bristles are formed by chemically treating coagulated fibers 3 to separate the individual bristles 4. The method of making these bristles is disclosed in U.S. Pat. No. 5,133,590 which is incorporated herein by reference.

The intertwisted wire segments 2 form a core 5 and, as described below and shown in FIGS. 5 to 16*b*, the core 5 is bent to form a loop or eye-type configuration, the free ends of the core being connected with each other by being threaded through an eye—not shown in the drawing—to form a handle 6. The bristles held between the twisted wires of the core 5 project from the core in all directions resulting in the bristle envelope 8 shown in FIGS. 5 to 12. Each of the loops or eye-type configurations shown in the drawing comprises an internal chamber or reservoir 7 entirely encased by the respective core 5 and only partially filled with bristles, as is the case with the embodiments according to FIGS. 5 to 13*b*,and 21 or entirely filled with bristles in accordance with the embodiments of FIGS. 14*a* to 16*b*.

Figure 5:
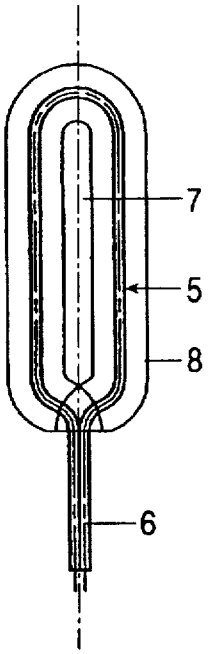
FIGS. 5 to 12 are plan views of various embodiments of a mascara brush according to the invention.
Figure 6:
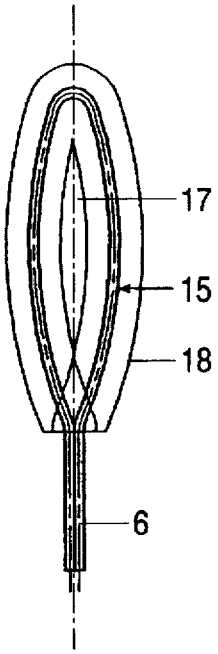
Figure 7:
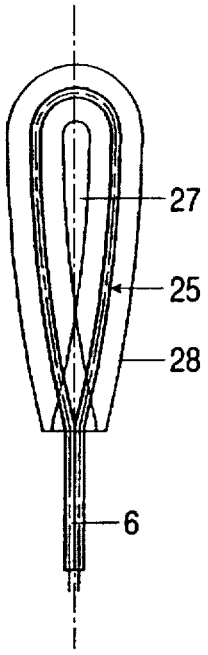
Figure 8:
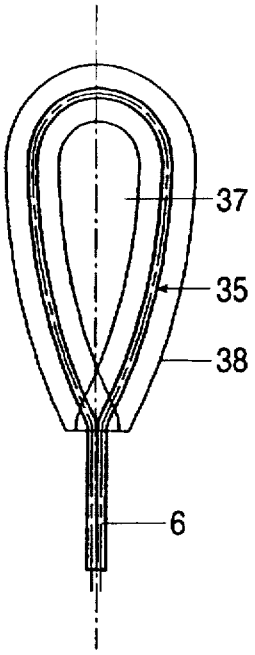
Figure 9:
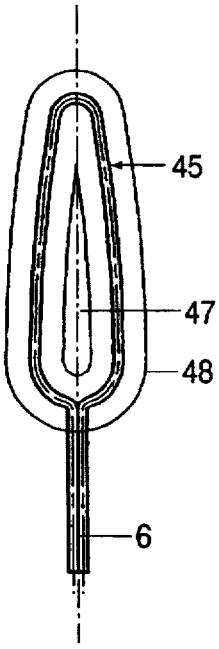
Figure 10:
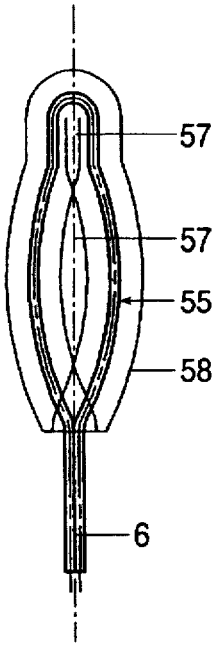
Figure 11:
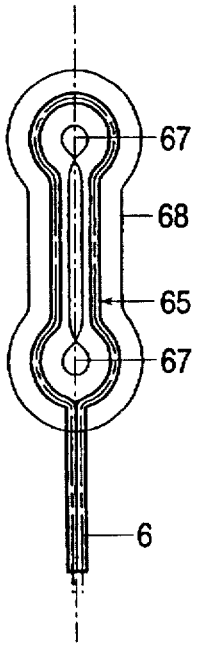
Figure 12:
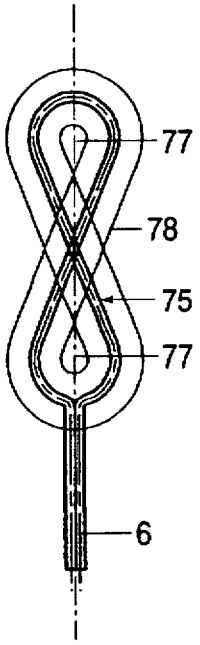
Figure 21:
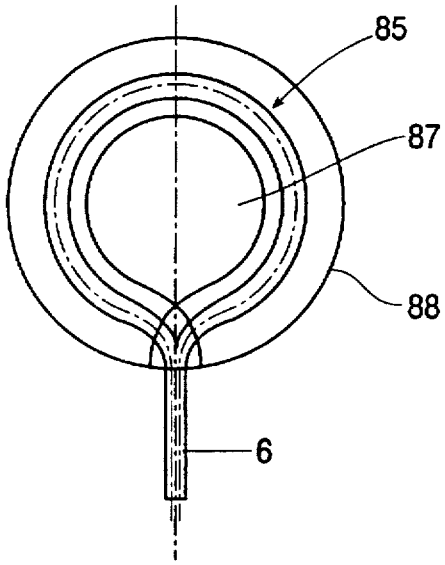
FIG. 21 illustrates a plan view of a further embodiment of a mascara brush according to the invention.

In the embodiment according to FIG. 5, the eye-type configuration has a substantially rectangular shape, while the embodiments according to FIGS. 6 to 9 illustrate symmetric oval (FIG. 6) and asymmetric drop-shaped configurations (FIGS. 7 to 9). FIG. 21 illustrates a circular configuration. The embodiments according to FIGS. 10 through 12 illustrate alternatives comprising two eye-type configurations formed from a single core 5. In the embodiment according to FIG. 12, the bent core 5 is twisted once again by 180° to take a figure eight shape. As shown in FIGS. 5-12 and 21, reference numbers 5, 15, 25, 35, 45, 55, 65, 75, and 85 denote the bent cores of the different embodiments depicted in FIGS. 5-12 and 21, respectively; reference numbers 7, 17, 27, 37, 47, 57, 67, 77, and 87 denote the reservoirs in same; and reference numbers 8, 18, 28, 38, 48, 58, 68, 78, and 88 denote the envelope curves of the bristles of same.

Figure 13A:
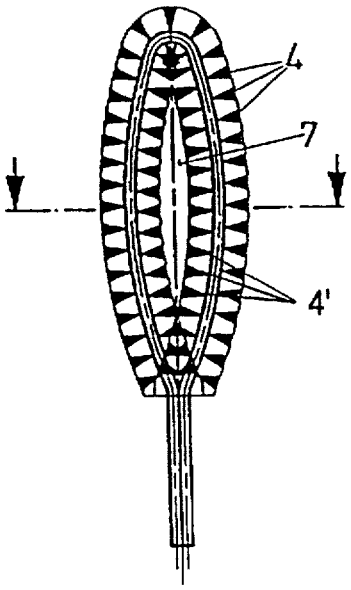
Figure 14A:
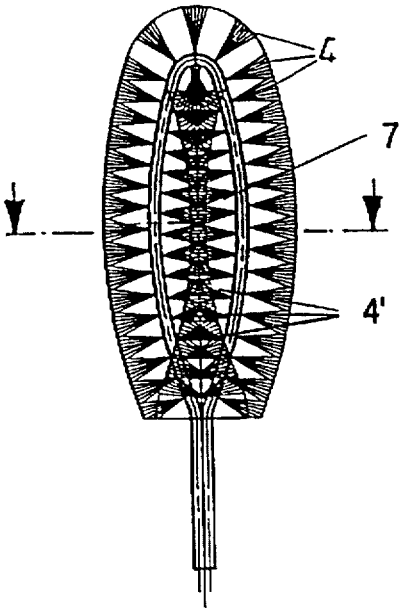
Figure 13B:
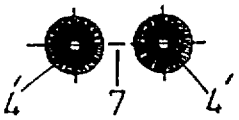
Figure 14B:
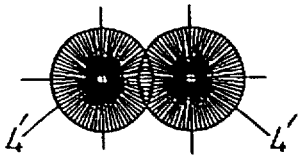

FIGS. 13*a* and 13*b* show the bristles 4 in the case of an oval configuration, FIG. 13*a* illustrating a plan view and FIG. 13*b* a cross-section taken at the line shown. In this 15 embodiment, the bristles 4'projecting toward the interior of the eye-type configuration do not meet, the gap between the bristle tips thereby resulting in an open internal chamber or reservoir 7. An alternative embodiment is illustrated in FIGS. 14*a* and 14*b*, wherein the interior bristles 4'meet and/or overlap resulting in an internal chamber or reservoir 7 entirely filled with bristles.

FIGS. 15*a* and 15*b* illustrate an embodiment of a substantially elongated, rectangular eye-type configuration, the resulting envelope curve 8 of the bristles 4 being clipped along the lines 9 so that the finished brush has bristles exhibiting a cylindrical envelope curve 8. Consequently, as shown in the section view of FIG. 15*b*, the lateral portions 10 of a brush thus produced have short bristles suitable for combing and separating the lashes, and the lateral portions 11 have longer bristles for applying the mascara. The bristles of lateral portion 11 are being fed from a liquid reservoir formed by the internal chamber 7 of the eye-type configuration. Further, such a brush exhibits bristles 4 projecting in paint-brush fashion in the vicinity of its distal end 12. Advantageously, milling of the bristles may be utilized to establish a uniform density of bristles throughout the brush.

Figure 17:
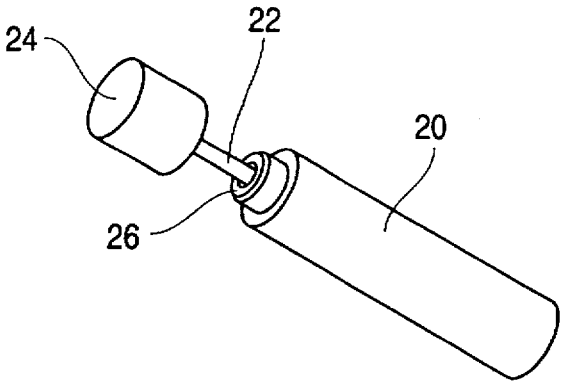
FIG. 17 is a perspective view of a mascara container utilizing a brush according to the present invention.

Finally, FIGS. 16*a* and 16*b* illustrate an embodiment in which the mascara brush is formed by at least four intertwisted wire segments fashioned into two separate cores 5,5'preferably fitted together at 90° and whose ends are joined to form a handle 6. In this embodiment, use may be made of especially thin wire of a diameter of about 0.25 mm. FIG. 17 illustrates mascara container 20 as used with brush 22 according to the present invention. Brush 22 may be constructed according to any of the embodiments previously described herein. As illustrated in FIG. 17, brush 22 is provided with handle 24. As is known in the art, container 20 has an opening surrounded by wiper 26. The wiper and brush are configured and dimensioned to cooperate upon removal of the brush so as to remove excess mascara from the brush as it is withdrawn from the container.

Figure 18:
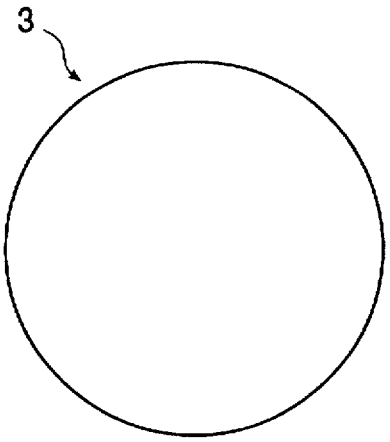
FIG. 18 illustrates a cross-sectional view of a circular bristle contemplated for use with the present invention.
Figure 19:
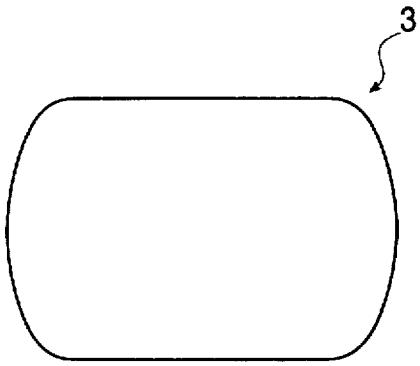
FIG. 19 illustrates a cross-sectional view of a non-circular bristle contemplated for use with the present invention.
Figure 20:
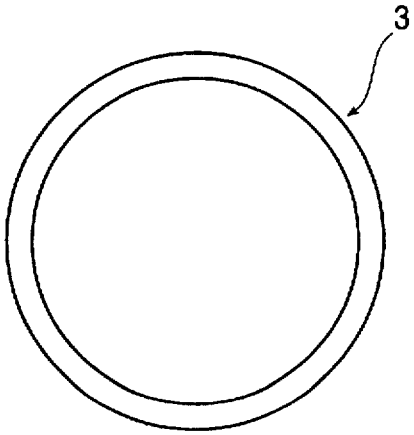
FIG. 20 illustrates a cross-sectional view of a hollow bristle contemplated for use with the present invention.

FIGS. 18–20 depict various cross-sections of bristles 3 contemplated for use with the present invention including circular, non-circular, and hollow cross-sections, respectively. The bristles may be natural or plastic fibers. In the case of plastic fibers, they may be polyamide, polyester or polyacrylic fibers having a diameter from about 0.05 mm to about 0.35 mm.

While there have been described what are at present considered to be the preferred embodiments of this invention, it will be obvious to those skilled in the art that various changes and modifications may be made without departing from the invention and it is, therefore, aimed to cover all such changes and modifications that fall within the true spirit and scope of the invention.

What is claimed is:

1. A mascara brush comprising:

a bent intertwisted wire core; and means for combing, separating, and coating eyelashes, wherein said means comprises a plurality of bristles fixed in place by the bent intertwisted core, said core forming at least one reservoir of eye-type configuration, said brush being configured and dimensioned to be passed through an opening of a mascara container, said bristles having a stiffness sufficient to apply mascara to eye lashes, and with said at least one reservoir being configured and dimensioned to receive mascara for application to the eye lashes.

2. A brush according to claim 1, wherein said bent core consists of a first end and a second end, said first and second ends united to form a handle.

3. A brush according to claim 1, wherein said at least one reservoir of eye-type configuration has a shape selected from the group consisting of rectangular, oval, drop-shaped and circular.

4. A brush according to claim 3, wherein a single reservoir is provided.

5. A brush according to claim 1, wherein said core is elongated and twisted to form a figure eight shape.

6. A brush according to claim 1, wherein a plurality of cores are provided.

7. A brush according to claim 1, wherein the ends of said bristles extending towards said at least one reservoir of eye-type configuration are spaced relative to each other such that an open inside cavity is formed in said brush, said cavity encased by the ends of the bristles.

8. A brush according to claim 1, wherein said bristles have a uniform density throughout said brush, said uniform density being established by milling thereof.

9. A brush according to claim 1, wherein said at least one reservoir of eye-type configuration has an approximately rectangular cross-section and said bristles are substantially rotationally symmetrically positioned about said core, with said core being off-center, and said bristles comprise portions of short fibers of greater rigidity and portions of longer fibers exhibiting greater flexibility.

10. A brush according to claim 1, wherein said wire exhibits a diameter of from about 0.25 mm to about 1.25 mm.

11. A brush according to claim 1, wherein about 5 to about 60 bristles are fixed in place between each twist of said intertwisted wire core.

12. A brush according to claim 1, wherein about 5 to about 60 bristles are fixed in place between each said wire twist.

13. A brush according to claim 1, wherein said bristles have a cross-section which is selected from the group consisting of circular, noncircular and hollow and exhibit a diameter of about 0.05 mm to about 0.35 mm.

14. A brush according to claim 13, wherein said bristles are selected from the group of natural or synthetic bristles.

15. A brush according to claim 1, wherein said bristles comprise at least one end which is split.

16. A brush according to claim 1, wherein said core is bent by approximately 180°.

17. A brush according to claim 1, wherein said core comprises at least two intertwisted wire segments with said bristles fixed in place between said segments.

18. A cosmetic brush comprising:

a handle;

a wire core extending from said handle, said cord bent to form a single loop; and means for combing, separating, and coating eyelashes, said means comprising a plurality of bristles mounted to said core, said bristles extending towards the interior of said loop to form a reservoir adapted to receive a mascara, wherein said bristles are configured and dimensioned and have a stiffness sufficient to apply said mascara to eyelashes.

19. A brush according to claim 18, wherein said bristles have a uniform bristle density throughout said brush.

20. A brush according to claim 17, wherein said wire core comprises two intertwisted wire segments and said bristles are held between said twisted wire segments.

21. A brush according to claim 20, wherein said wire segments exhibit a diameter of from about 0.25 mm to about 1.25 mm.

22. A brush according to claim 21, wherein from about 5 to 60 bristles are held between each wire twist.

23. A brush according to claim 22, wherein more than 50 bristles are held between each wire twist.

24. A brush according to claim 18, wherein said bristles have a cross-section which is selected from the group consisting of circular, noncircular and hollow, said bristles having a diameter of from about 0.05 mm to about 0.35 mm.

25. A brush according to claim 24, wherein said bristles are selected from the group of natural or synthetic bristles.

26. A brush according to claim 24, wherein said bristles are synthetic fibers chosen from the group consisting of polyamide, polyester and polyacrylic.

27. A brush according to claim 26, wherein at least one end of each said bristle is split.

28. A brush according to claim 24, wherein said bristles exhibit a diameter of from about 0.05 mm to about 0.10 mm.

29. A brush according to claim 18, further comprising:

a mascara container adapted to contain mascara and defining an opening for access to the mascara; and a wiper element surrounding the opening wherein the wiper element and brush are configured and dimensioned to cooperate to remove excess mascara from the brush as it is withdrawn from the container.

30. A brush according to claim 18, wherein a single loop is provided.

31. A brush according to claim 18, wherein two loops are provided.

* * * * *

UNITED STATES PATENT AND TRADEMARK OFFICE
CERTIFICATE OF CORRECTION

PATENT NO. : 5,761,760

DATED : June 9, 1998

INVENTOR(S) : DUMLER et al.

It is certified that an error appears in the above-identified patent and that said Letters Patent is hereby corrected as shown below:

Column 3, line 57, delete "and".

Column 4, line 31, replace ",and 21" with -- and 21,--.

Column 6, claim 12, delete "1, wherein about 5 to about 60 bristles are fixed in place between each said wire twist", and insert --11, wherein the diameter of said bristles is from about 0.05 mm to about 0.10 mm--.

Signed and Sealed this

Sixth Day of October, 1998

*Attest:*

*Attesting Officer*

BRUCE LEHMAN

*Commissioner of Patents and Trademarks*